United States Patent [19]

Huber et al.

[11] 4,091,819

[45] May 30, 1978

[54] PADDED BRASSIERES

[75] Inventors: William Huber, Renfrew, Scotland; Nathan D. Field, Wyckoff, N.J.; Herman L. Marder, Plainfield, N.J.; Raymond C. Cole, Hillsdale, N.J.

[73] Assignee: International Playtex, Inc., New York, N.Y.

[21] Appl. No.: 781,613

[22] Filed: Mar. 28, 1977

Related U.S. Application Data

[63] Continuation of Ser. No. 585,928, Jun. 11, 1975 abandoned.

[51] Int. Cl.[2] ..... A41C 3/10

[52] U.S. Cl. ..... 128/479; 128/517

[56] References Cited

U.S. PATENT DOCUMENTS

| | | | |
|---|---|---|---|
| 404,881 | 6/1889 | Wheeler | 128/517 X |
| 2,346,318 | 4/1944 | Marx | 128/517 X |
| 2,691,166 | 10/1954 | Roth | 128/517 X |
| 2,864,373 | 12/1958 | Buckley | 128/481 |
| 2,940,453 | 6/1960 | Lerner | 128/479 X |
| 3,542,634 | 11/1970 | Such et al. | 128/481 X |
| 3,682,756 | 8/1972 | Kalwaites | 28/722 F X |
| 3,814,107 | 6/1974 | Greenblatt et al. | 128/510 X |

OTHER PUBLICATIONS

"Molded Fabrics and Molded Padding", *Body Fashions*, Jun. 1972.

*Primary Examiner*—Werner H. Schroeder
*Assistant Examiner*—Moshe I. Cohen
*Attorney, Agent, or Firm*—Stewart J. Fried; Jeffrey A. Schwab

[57] ABSTRACT

Improved padded brassieres in which the padding layer within the cup structure includes a batting of fibers formed together into a cohesive fibrous web, the batting having a plurality of areas devoid of fibers to provide a patterned openwork structure. The open areas are typically in the range of approximately 1/32 to ¼ of an inch in length and width, arranged in rows of predetermined linear alignment to provide an aesthetic arrangement having porosity, strength, integrity and excellent drapable characteristics.

10 Claims, 6 Drawing Figures

PADDED BRASSIERES

This is a continuation of application Ser. No. 585,928, filed June 11, 1975 now abandoned.

BACKGROUND OF THE INVENTION

The present invention relates to a form of brassiere construction having an improved form of padding.

In order to enhance bust contour, comfort and shape and/or to cosmetically improve the perceived size of the bust, many women wear brassieres which include some form of padding layer within the cup structure. The term "brassiere" is used in the broad sense and is applicable to halters, bathing suits, and other women's garments which incorporate breast receiving cups. As a matter of convenience, a bandeau brassiere is being discussed as exemplary.

Padded brassieres originally incorporated sponge or foam rubbers or like materials for padding. The use of these materials has in many instances proven unsatisfactory. These materials possess poor porosity and have been found to be unable to withstand machine washings or drying at elevated temperatures, exhibit poor stress crack resistance and yellow with age.

Recently, the material generally employed for brassiere padding has been a layer of some form of non-woven, bound staple fibers, such as polyester. This layer is typically laminated on either one or both sides to a thin knitted or woven textile material. This form of padding is generally referred to as "fiberfill." It is the same basic material employed in outer wear as a heat retaining and insulating interlining.

Because fiberfill padding is relatively lightweight and can be relatively economically produced, it has, for the most part, replaced materials such as foam rubber and sponge as brassiere cup padding.

However, fiberfill paddings, although commercially acceptable, also have many deficiencies. The heat insulation properties of fiberfill padding, although highly desirable for outer wear interlinings, is not desirable in brassieres. Although, fiberfill paddings exhibit greater stability and chemical durability than rubber foam or the like, it has been found that fiberfill may be subject to pilling and bunching up after prolonged wear and laundering.

Some workers have suggested solving this latter problem through needle punching of the material and/or the addition of a greater proportion of binder to the non-woven fiberfill batting. While such steps may improve the overall strength of the fiberfill and deter pilling and bunching up, they can negatively affect other characteristics particularly desirable for brassiere cup padding. In particular, the adding of additional binders and/or needle punching oftentimes stiffens the fiberfill and has a negative affect on the loft and resiliency characteristics desired.

While the shape of the female breast is sometimes referred to as hemispherical, in fact, it is a complex curvilinear surface. The more naturally a brassiere cup conforms to the shape of a woman's breast, the more acceptable the garment. Thus, in addition to the other negatives which arise in imparting stiffness to fiberfill padding to enhance its durability characteristics, there is the additional problem that the fiberfill padding will less readily conform to the cup shape since the padding does not drape well within the cups.

This latter problem is even more significant today where molded, rather than cut and sewn cup structures are being employed in the manufacture of brassieres. Molding permits the brassiere cups to be formed with more complex curvilinear detail than cut and sew cups. However, where the stiffness of the fiberfill is such that it does not closely drape within the cups, this benefit is lost. The brassiere may then have a too artificial or structured appearance.

It has been found that this problem is not simply solved by molding the fiberfill in a like manner as employed in molding the brassiere cups themselves. The fiberfill as noted before, is not a knit or woven material nor is it as thin or supple as such fabrics. Initial emplacement of the planar extent of fiberfill over, for example, a male molding die requires that the fiberfill be readily drapable, and not stiff. However, the force of molding creates substantial pressures on the fiberfill, especially at the nipple area and additional strength is needed to prevent rupture of the batting.

Thus, both with regard to cut and sewn brassiere cup structures and molded brassiere cup structures, there is a need to provide a fiberfill which is cooler to wear, has good loft and resiliency and be sufficiently supple to drape well within the cup structure. These attributes are highly desirable not only where the fiberfill is within the three dimensional area of the cup itself, but also wherever fiberfill is employed in a brassiere. For example, fiberfill is used in some brassiere constructions along the frame or bordering structure about the outer perimeter of the cups to cushion the skin of the wearer. It has also been suggested that fiberfill be interposed in a brassiere of the so-called underwire type, between the underwire and the wearer's body.

The present invention is directed to a fiberfill providing a solution of all of these problems. According to the present invention, a fiberfill padding, particularly suitable for brassiere cups is provided, with the fiberfill padding including a batting of fibers formed together into a cohesive fibrous web, the batting having a plurality of perforations or open areas devoid of the fibers extending through the batting, with interstitial areas of fibers between such open areas and a layer of covering material superimposed on at least one surface of the batting. Not only do the open areas serve to vent the fiberfill and aesthetically lighten its appearance, the patterned open work structure improves the ability of the fiberfill to be draped and shaped within the cup to which it is mated. Because of the added drape and suppleness imparted by the patterned openwork structure, techniques such as needle punching and the use of a relatively high concentration of binders can be employed to impart the particular strength and durability characteristics needed for brassiere cups.

Heretofore, where perforations or openings have been desired in a lining for a brassiere cup, either a woven or plastic material has been used (see U.S. Pat. No. 3,062,216 to Stein). One prior worker has even suggested the use of polyurethane (see German Publication *Bekletdung Und Wasche* by Moeller, 1969 pages 1781–82) although polyurethane foam is known to discolor badly.

Where enhanced drape has been desired, it has been suggested that one provide fiberfill with very narrow slits having a transverse width of approximately zero, e.g. U.S. Pat. No. 3,764,450 to Tesch, with the resultant structure being a closed non-vented material.

These two types of approaches, i.e. the use of plastics or woven in lieu of non-woven materials, or the use of closed slits have not been unexpected in view of the durability requirements desired in the brassiere padding. An openwork pattern creating areas of non-overlapping fibers would seemingly result in a non-commercially weakened structure having a greater propensity to pill during laundering.

According to the present invention, it has been discovered, however, that a regular pattern of openings can be made in a fiberfill material prepared from synthetic fibers, such as staple polyester fibers with the resultant product having sufficient density to withstand launderability; a high degree of loft and flexibility; an aesthetically pleasing appearance; and because of the openings, provide a vented and thus more comfortable brassiere cup structure.

The fiberfill generally employed in brassieres today are generally made of staple synthetic fibers such as polyester, with various binders. Thus, the various examples and ranges disclosed herein are based upon such typical uses. It is understood that the range of weight and density of the fiberfill may vary based upon specific usage. It is understood, however, that the batting may be formed by other means, for example, from a spun bonded process or from a continuous filament material.

Similarly, while many weight and density ranges may be employed, generally the weights are in the ranges of between 40–400 grams per cubic centimeter.

Referring to products employing a non-woven batting of staple synthetic fibers having the above average weights and thicknesses, particularly in the 80 to 210 gram perimeter range, it has been found that providing openings typically having a length and width in the range of 1/32nd of an inch to ¼ of an inch, sufficient flexibility is imparted to the fiberfill and higher than normal ranges of needle punching and/or binding additives can be employed to enhance strength without negatively affecting the hand, suppleness and wear life characteristics desired.

Where this form of fiberfill is used, it is preferred that the padding includes as the basic batting material, synthetic fibers, thermoplastic or non-thermoplastic, such as staple polyester fibers which are crimped to provide increased holding force between the fibers. The fibers are formed into a carded web, employing any one of the well-known systems such as by the randomizing method, where all the fibers are randomly oriented in different directions and, preferably, with a majority of the fibers (2:1) oriented in a lengthwise direction. The fiberfill web which is formed may have a density in the range of 1½ to 10 ounces per square yard. This density range has been found to be highly suitable since a denser web makes it difficult to evenly apply binders to the entire thickness of the material and a web of lower density could present an uneven batt and be thus less suitable for forming openings therein.

After such a fiberfill web is formed, it may be needle punched to interengage fibers for strength and to improve both the surface uniformity of the material and the hand or feel of the web.

A binder may then be applied in order to improve the strength, durability, washability and loft characteristics of the material. Generally known resins may be employed such as forms of acrylic, polyester or acetate or a combination of all of these. The resin mixture is applied to the batting, such as by being sprayed on the batting web with the resin penetrating the thickness of the web. A relatively high resin concentration can be applied because as hereinafter described openings are to be provided which give greater flexibility to the finished batting. The material is then dried.

Openings or perforations are then provided in the material. The openings may be formed in any suitable manner. For example, the material may be slit and expanded; or a pattern of holes may be formed in the web by striking it with a die having a plurality of cutting surfaces formed thereon; or the web may be fed through a role slitter having a plurality of cutting blades. Other procedures well-known in the art may also be used.

In one form of the invention, the fiberfill web includes approximately 100 to 120 openings or perforations per square inch. The holes should be of a visible size, and typically have a length and width in the range of approximately 1/32 of an inch to ¼ of an inch. It has been found that if the holes are of a smaller size, they tend to become less visible with time and the material is somewhat stiff and does not have the desired hand or feel. If the holes are of a larger size, it has been found that they are difficult to stabilize and the material is too flexible and becomes too weak. It is to be understood that the thickness of the web may vary depending upon the ultimate thickness desired in the finished fiberfill product. In thicker webs the openings are generally made larger than in thinner webs. The openings may be arranged in any desired pattern, such as a side-by-side grid arrangement. However, for aesthetic purposes, it has been found desirable to arrange the openings in a pattern of columns where in adjacent rows the openings alternate with each other.

The perforated batting material may then be bonded between an inner and outer fabric layer and cut to the desired size and shape to form a bra cup pad or, as is known, fabric may only be bonded to one side of the batting, with the inner surface of the brassiere cup serving as a second fabric layer.

While the openings in the fiberfill can be aligned in any desired manner by varying the pattern or shape of the openings and/or the alignment of the fiberfill vis-a-vis the brassiere cup structure, the stretch and drape characteristics of the fiberfill can be best utilized to meet the aims of the brassiere designer. Thus, for example, less horizontal give or stretch can be provided in the lower segment of a brassiere cup to impart additional supportive characteristics and some give or stretch can be provided in the upper segment of the brassiere cup for comfort and better adaptation to shape.

These and other advantages of the present invention will be more fully apparent in light of the following detailed description, taken in connection with the accompanying drawings in which like numerals denote like parts.

Figure 1:
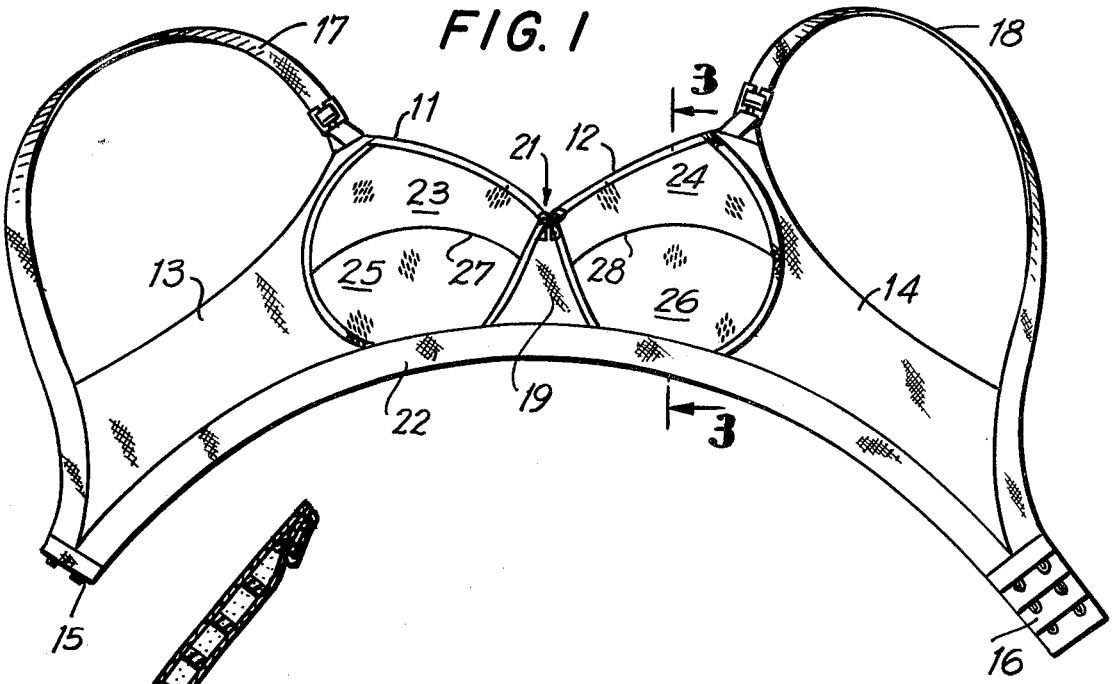
FIG. 1 is a front elevation of a preferred embodiment of the padded brassiere of the present invention.

The brassiere shown in FIG. 1 comprises breast cups 11, 12, side portions 13, 14, with a hook and eye arrangement 15 and 16 for rear closure and shoulder straps 17 and 18. The particular brassiere structure shown is for illustrative purposes and is of the type described in U.S. Pat. No. 3,322,127 to Sachs granted May 30, 1967. Such construction incorporates a triangular fabric section 19 below the midpoint 21 of the brassiere, and an underbust band 22 extending across the front of the brassiere and under the cups 11 and 12. The structure of the brassiere will be more fully understood in the light of the disclosure of the aforesaid Sachs '127 patent, the disclosure of which is incorporated by reference herein.

The cups 11 and 12 (which are generally conical to hemispherical shape) comprise upper segments 23, 24, lower segments 25, 26 with respective upper and lower segments 23, 25 and 24, 26 secured together along seam lines 27, 28 in the manner well known in the art.

Figure 3:
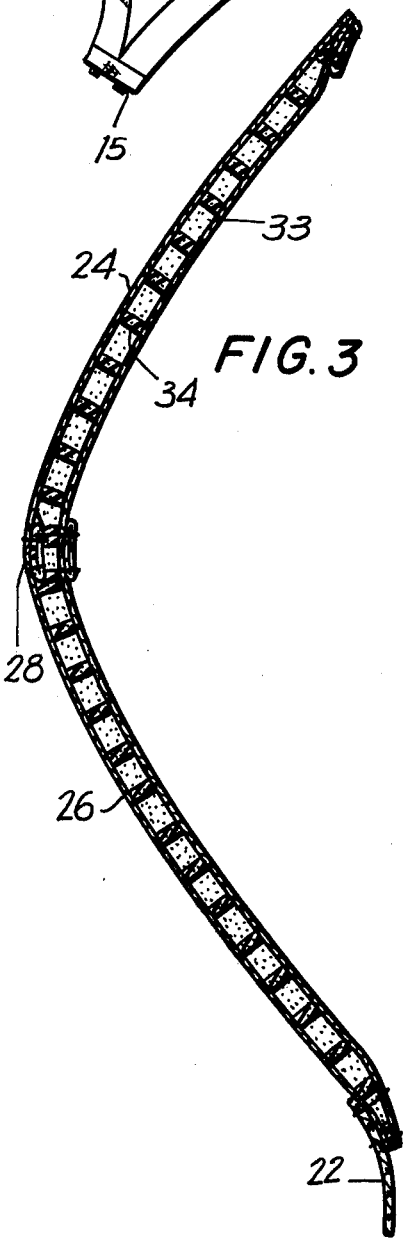
FIG. 3 is a cross-section taken along the line 3—3 in FIG. 1.
Figure 2:
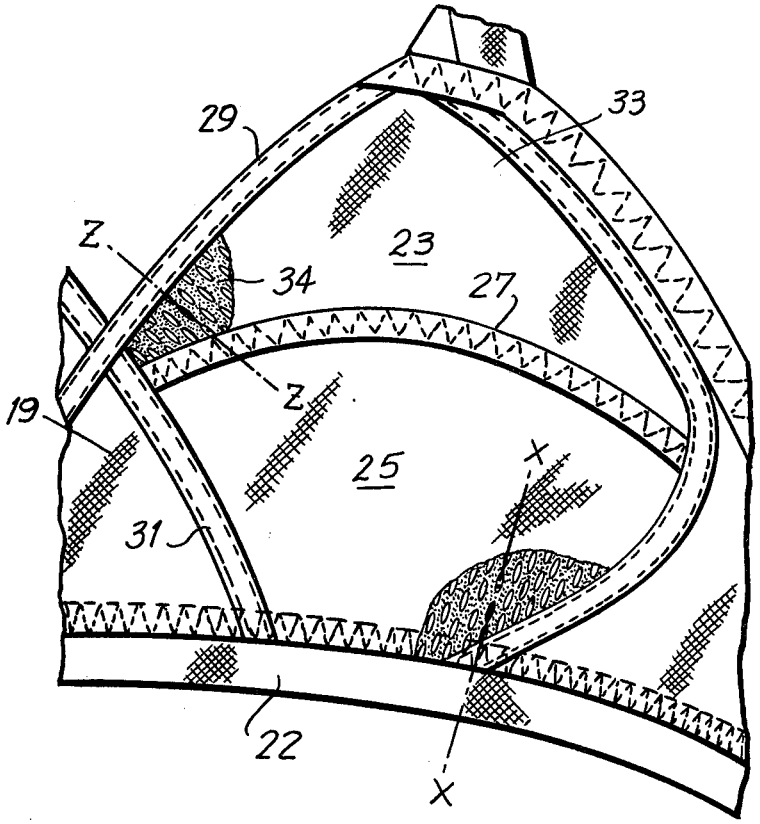
FIG. 2 is an enlarged, partial rear elevation showing one of the brassiere cups, with portions broken away to indication the orientations of the perforated fiberfill padding material in the respective segments thereof.
Figure 4:
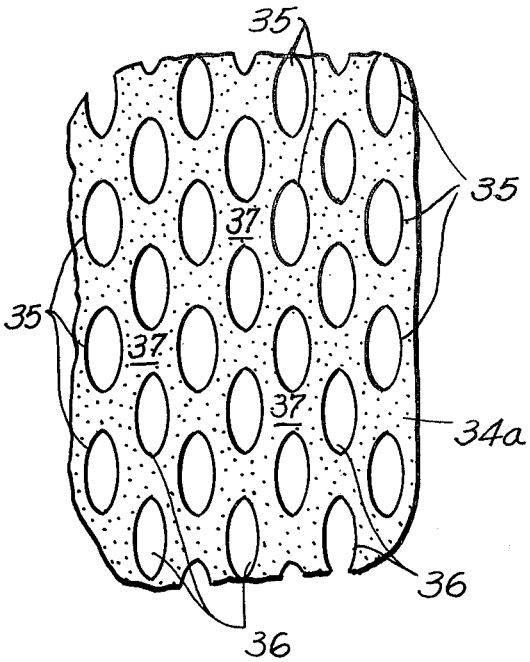
FIG. 4 is an enlarged plan view of the perforated layer.

In the illustrations shown in FIGS. 2–4, the perforate fiberfill batting 34 includes fabric covering 33 on one side thereof with the covering for the opposite layer of the fiberfill batting 34 being the cup fabric 23–26 material.

The perforate fiberfill batting material 34 is obtained from the perforate sheet material 34*a* illustrated in FIG. 4. As shown therein, the perforations are in the range of 1/32 to ¼ in width and length and extend in longitudinal, alternating rows 35 and 36. In this embodiment, the individual perforations in the respective rows are laterally offset from one another. Due to the ability to employ additional binding agents, the interstitial areas 37 between the respective perforations are of a relatively high density and in such areas impart increased strength to the padding material. In addition, where a slitting, and expanding method is used in forming the openings, the interstitial areas 37 are compacted which also imparts additional strength providing areas of even higher localized density to the material 34*a*.

The fabric layer 33 may comprise any suitable fabric, whether stretchable or non-stretchable. Examples of suitable fabrics include knitted fabrics such as tricot and jersey, Helanca, stretchable cotton fabrics, elastic fabrics containing rubber, and the like. Non-stretchable fabrics which may be so employed include woven materials such as cotton.

The perforate fiberfill padding is bonded to the fabric layer 33 and the fabric which makes up the cup material 23-26. The bonding between the respective layers may be achieved by means well known in the art such as by stitching or by laminating the three layers to one another across all or a portion of their respective faces. Since the outer covering layers are primarily employed to permit ease in the securing of the padding material to the frame of the brassiere, the means of securement between these layers and the fiberfill batting layer 34 need not be permanent and bonding agents which wash away in laundering are suitable. See, for example, U.S. Pat. No. 3,574,105 to Sachs.

One example of the versatility of the present invention may be seen from FIG. 2, where, in the lower segment 25 of the cup 11 (and similarly segment 26 of cup 12) the perforations in the fiberfill padding material are so oriented that they are generally vertically aligned relative to the cup i.e., along axis lines X—X. On the other hand, the upper segment 23 of the cup 11 (and similarly segment 24 of cup 12) has the padding perforations aligned on a bias extending inwardly and upwardly from the seam 27 (and 28) toward the mid-point 21 of the brassiere i.e., along axis lines Z—Z. In this manner greater flexibility is imparted to the upper cup segments of the respective cups for comfort and adaptability of fit. Other arrangements may occur to those skilled in the art depending upon the materials used and the end result desired.

Figure 5:
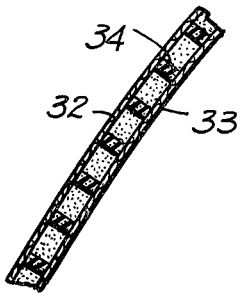
FIG. 5 is a cross-section of an alternate form of the fiberfill of the present invention.

As shown in FIG. 5, the fiberfill may include a fabric covering 32 separate from the cup material 23-26. Such a construction facilitates the cutting of the fiberfill material to size for emplacement within the cup structure and selective orientation of the perforate pattern within the cup structure itself.

In view of the fact that the pattern of perforations or openings may be aesthetically arranged, the covering fabric whether part of the cup structure or a separate piece may be of a sufficiently sheer fabric such that the perforate pattern is visible therethrough. The light, airy appearance thus imparted provides a marked aesthetic departure from padded brassieres theretofore available and permits the use of openwork lace patterns in padded brassiere cup construction.

However, of even greater significance is the improved coolness that is imparted. Independent testing has shown that the perforate fiberfill is cooler than comparable non-perforate fiberfill, thus providing all of the positive attributes of fiberfill while significantly reducing the heat retention properties of the fiberfill. By using a porous material for the covering fabric(s), this increased coolness may be employed.

Figure 6:
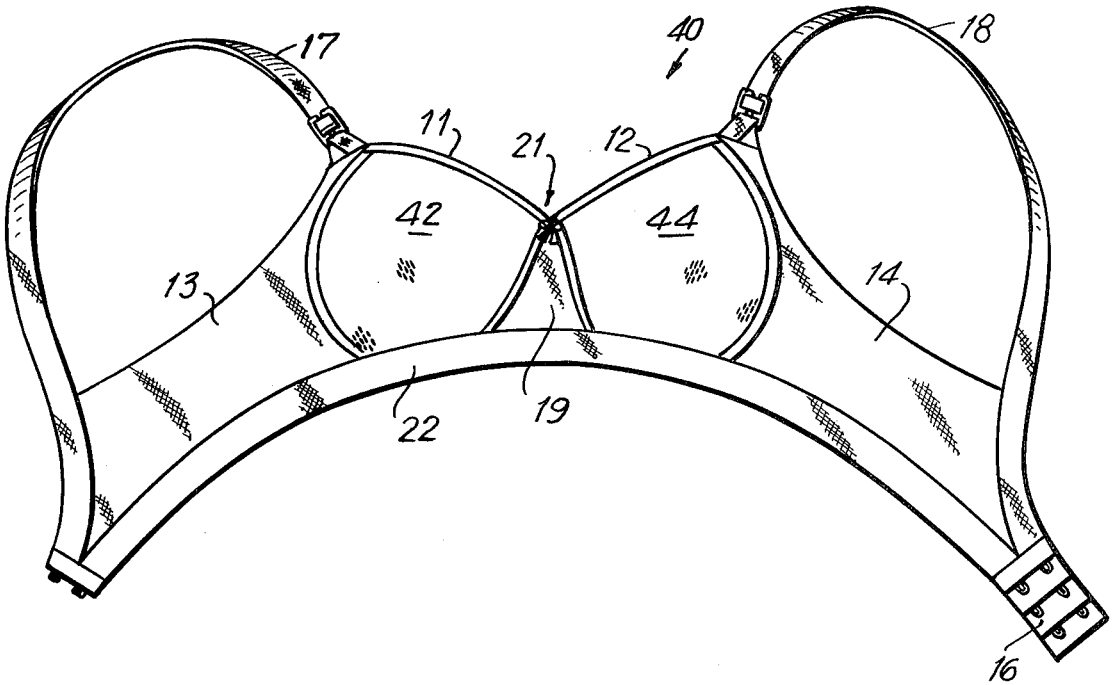
FIG. 6 is a front elevation of another embodiment of a brassiere of the present invention.

FIG. 6 illustrates an embodiment in what is generally referred to in the industry as a seamless brassiere. In lieu of the cut, sewn joined cup elements 23,24,25,26 shown in FIG. 1, the cups 42,44 of the brassiere 40 of FIG. 6 are molded to shape. Secured to the inside of each cup 42,44 is a molded perforate fiberfill layer of material. Where it is desirable to totally eliminate central seaming from the cups 42,44 even on the interior thereof, each fiberfill layer is a single unit and the pattern of openings is uniform throughout the cup. The fiberfill batting may be formed in a like manner as that hereinbefore described. However, prior to emplacement within the cups 42, 44, the planar extent of the material is molded, such as by emplacement over a male die of predetermined contour. The openwork pattern permits greater ease in deforming the relatively thick planar extent to drape over the mold. In its preferred form the fiberfill material is a polyester which can be stabilized upon the application of heat. Thus after proper emplacement of the mold, the fiberfill can be heat set for permanent shaping and more precise alignment within the cup structure of the brassiere 40.

Because drapability is enhanced by the perforate pattern of openings the pressure required to deform the fiberfill is reduced thus, less strain is emplaced on the fiberfill especially at its apex or nipple area. There is thus a lesser change of rupture at the apex and a lesser degree of loft and resiliency is lost in the molding process. While the deformation may slightly modify the uniformity of the opening size and the uniformity between opening a relative uniformity will be maintained.

As heretofore noted the perforate fiberfill of the present invention may be used for all purposes, where fiberfill has heretofore been employed in brassieres.

It will be understood that various modifications may be made in the preferred embodiments exemplified herein without departing from the scope of the invention. The preceeding description is intended as illustrative.

What is claimed is:

1. A brassiere construction including cups having a fiberfill padding wherein said fiberfill padding includes a non-woven batting of synthetic fibers formed together into a cohesive web, said batting having a plurality of open areas extending completely through the thickness of said batting and interstitial areas including said fibers between said open areas, said batting having at least a portion of the fibers interengaged for strength, said open areas typically in the range of approximately 1/32 to ¼ of an inch in length and width, the faces of said batting being substantially planar and a layer of covering material superimposed and secured along its surface to at least one face of said batting, said fiberfill material secured to a surface of said brassiere.

2. A brassiere as claimed in claim 1 wherein said fiberfill material is secured to the inner surface of each of said cups.

3. A brassiere construction as claimed in claim 1 further including a second layer of covering material superimposed on the opposite face of said batting.

4. A brassiere construction as claimed in claim 3 wherein said covering materials are porous.

5. A brassiere construction as claimed in claim 3 wherein said second layer of material includes the inner surface of a brassiere cup.

6. A brassiere construction as claimed in claim 1 wherein said open areas are arranged in rows of linear alignment.

7. A brassiere construction as claimed in claim 6 wherein adjacent rows of said open areas are laterally offset one from the other.

8. A brassiere construction as claimed in claim 2 wherein each of said brassiere cups includes an upper section and a lower section, and the open areas of said padding are an arrangement in rows of linear alignment; and wherein said linear rows are in substantial vertical alignment in said lower cup sections and in a bias direction in said upper cup section.

9. A brassiere construction as claimed in claim 2 wherein the open areas of said padding along a given portion of said cup is aligned in a first direction and the open areas of said padding along another portion of each said cup is aligned in a second direction.

10. A brassiere construction including cups having a fiberfill padding wherein said fiberfill padding includes a non-woven batting of synthetic fibers formed together into a cohesive web, said batting having a plurality of open areas extending completely through the thickness of said batting and interstitial areas including said fibers between said open areas, said batting having at least a portion of the fibers needle transferred in the direction of the thickness of said batting to interengage a portion of said fibers for strength, said interstitial areas being compacted, the faces of said batting being substantially planar and a layer of covering material superimposed and secured along its surface to at least one face of said batting, said fiberfill material secured to a surface of said brassiere.

* * * * *